US009695388B2

(12) United States Patent
Traynor

(10) Patent No.: US 9,695,388 B2
(45) Date of Patent: Jul. 4, 2017

(54) SOAP WITH DISPERSED ARTICLES PRODUCING LIGHT AND/OR SOUND

(71) Applicant: Daniel H. Traynor, Sarasota, FL (US)

(72) Inventor: Daniel H. Traynor, Sarasota, FL (US)

( * ) Notice: Subject to any disclaimer, the term of this patent is extended or adjusted under 35 U.S.C. 154(b) by 3 days.

(21) Appl. No.: 14/382,156

(22) PCT Filed: Mar. 4, 2013

(86) PCT No.: PCT/US2013/028836

§ 371 (c)(1),
(2) Date: Aug. 29, 2014

(87) PCT Pub. No.: WO2013/134109

PCT Pub. Date: Sep. 12, 2013

(65) Prior Publication Data

US 2015/0005224 A1 Jan. 1, 2015

Related U.S. Application Data

(60) Provisional application No. 61/606,443, filed on Mar. 4, 2012.

(51) Int. Cl.
*C11D 17/04* (2006.01)
*C11D 17/00* (2006.01)
(Continued)

(52) U.S. Cl.
CPC ..... *C11D 17/04* (2013.01); *C11D 17/0095* (2013.01); *C11D 17/048* (2013.01); *F21V 33/004* (2013.01); *F21W 2131/30* (2013.01)

(58) Field of Classification Search
None
See application file for complete search history.

(56) References Cited

U.S. PATENT DOCUMENTS 5,971,827 A 10/1999 Lee et al.
6,116,753 A * 9/2000 Tsang ..... C11D 17/048 362/101

(Continued)

FOREIGN PATENT DOCUMENTS

| | | |
|---|---|---|
| EA | 010387 B1 | 8/2008 |
| RU | 2039084 C1 | 7/1995 |
| RU | 2000111807 A | 4/2002 |

OTHER PUBLICATIONS

PCT International Search Report and Written Opinion, PCT/US2013/028836, Sep. 5, 2013, 7 pages.

*Primary Examiner* — Necholus Ogden, Jr.
(74) *Attorney, Agent, or Firm* — Quarles & Brady LLP

(57) ABSTRACT

A soap bar has a solid or semi-solid matrix comprising a cleaning composition; and one or more articles positioned in the matrix. The articles include an electrical source, a light source or a sound emitting device, and a pair of electrodes in spaced apart relationship. The pair of electrodes are in electrical communication with the electrical source and the light source or sound emitting device. The light source emits light when a conductive material creates a current path between the pair of electrodes. The sound emitting device emits sound when a conductive material creates a current path between the pair of electrodes. A section of the matrix covers the pair of electrodes and prevents the conductive material from creating the current path until the section of the matrix is removed thereby uncovering the pair of electrodes. Also disclosed is a melt and pour soap bar formulation including a cleaning composition; and a plurality of dispersed articles comprising a light source or a sound emitting device. The formulation is solid below 120° F., and the formulation can be remelted and remolded.

14 Claims, 4 Drawing Sheets

(51) Int. Cl.
*F21V 33/00* (2006.01)
*F21W 131/30* (2006.01)

(56) References Cited

U.S. PATENT DOCUMENTS

2003/0227775 A1 12/2003 Tsang
2007/0009313 A1 1/2007 Benkhardt

* cited by examiner

SOAP WITH DISPERSED ARTICLES PRODUCING LIGHT AND/OR SOUND

CROSS-REFERENCES TO RELATED APPLICATIONS

This application is a 371 application of PCT/US2013/028836 filed Mar. 4, 2013 which claims priority based on U.S. Patent Application No. 61/606,443 filed Mar. 4, 2012.

STATEMENT REGARDING FEDERALLY SPONSORED RESEARCH

Not Applicable.

BACKGROUND OF THE INVENTION

1. Field of the Invention

This invention relates to a soap bar and a melt and pour soap bar formulation including a transparent or translucent cleaning composition, and a plurality of dispersed articles comprising a light source that produces visible light or a sound emitter.

2. Description of the Related Art

Solid soaps for years have had different shapes, fragrances, formulations, textures, and marketing appeal. Formulations have been developed to include melt and pour, alcohol, and base.

Translucent soaps are available. Example translucent soaps include soaps which contain glycerin. It has been reported that the clarity of glycerin soaps is due to the alignment of the soap molecules, which can be induced through the addition of alcohol and sugar.

Clear glycerin soap bases can be made by combining glycerin or various polyols with soap and/or other surfactants. These clear glycerin soaps are easily remelted and remolded, and are often sold to consumers for melt-and-pour soap crafting.

Glycerin soap can also be made by melting and continuously heating soap that has been partially dissolved in an alcohol solution until the mixture reaches a clear, gel-like consistency. The alcohol is heated with a sugar solution until the soap is transparent or translucent, and then the soap is molded at a reduced temperature.

Glycerin types of soaps are not as commonplace on the market; however, these soaps offer advantages when it comes to producing a clear soap. The clear soaps which contain solvents or glycerin to make a semi transparent soap offer some visibility; however, these soaps may have some clouding associated with the formulation.

While transparent and translucent soaps are currently available, there is still a need for a soap product that takes further advantage of the transparency or translucency of various soap formulations.

SUMMARY OF THE INVENTION

In one aspect, the invention provides a soap bar including a solid or semi-solid matrix comprising a cleaning composition. The matrix is transparent or translucent, and an article is positioned in the matrix. The article includes an electrical source, a light source, and a pair of electrodes in spaced apart relationship. The pair of electrodes is in electrical communication with the electrical source and the light source. The light source emits light when a conductive material creates a current path between the pair of electrodes, and a section of the matrix covers the pair of electrodes and prevents the conductive material from creating the current path until the section of the matrix is removed thereby uncovering the pair of electrodes.

In another aspect, the invention provides a soap bar including a solid or semi-solid matrix comprising a cleaning composition. An article is positioned in the matrix, and the article includes an electrical source, a sound emitting device, and a pair of electrodes in spaced apart relationship. The pair of electrodes is in electrical communication with the electrical source and the sound emitting device. The sound emitting device emits sound when a conductive material creates a current path between the pair of electrodes, and a section of the matrix covers the pair of electrodes and prevents the conductive material from creating the current path until the section of the matrix is removed thereby uncovering the pair of electrodes.

In yet another aspect, the invention provides a soap bar including a solid or semi-solid matrix comprising a cleaning composition. An article is positioned in the matrix, and the article includes an electrical source, an emitting device that emits light and/or sound, and a pair of electrodes in spaced apart relationship. The pair of electrodes is in electrical communication with the electrical source and the emitting device. The emitting device emits light and/or sound when a conductive material creates a current path between the pair of electrodes, and the conductive material creates the current path when sensing light.

In still another aspect, the invention provides a soap bar including a solid or semi-solid matrix comprising a cleaning composition. An article is positioned in the matrix, and the article includes an electrical source, an emitting device that emits light and/or sound, and a pair of electrodes in spaced apart relationship. The pair of electrodes is in electrical communication with the electrical source and the emitting device. The emitting device emits light and/or sound when a conductive material creates a current path between the pair of electrodes, and the conductive material creates the current path when sensing a temperature change.

In yet another aspect, the invention provides a soap bar including a solid or semi-solid matrix comprising a cleaning composition. An article is positioned in the matrix, and the article including an electrical source, an emitting device that emits light and/or sound, and a pair of electrodes in spaced apart relationship. The pair of electrodes is in electrical communication with the electrical source and the emitting device. The emitting device emits light and/or sound when a conductive material creates a current path between the pair of electrodes, and the conductive material creates the current path when sensing a pressure change.

In still another aspect, the invention provides a soap bar including a solid or semi-solid matrix comprising a cleaning composition. An article is positioned in the matrix, and the article includes an electrical source, an emitting device that emits light and/or sound, and a pair of electrodes in spaced apart relationship. The pair of electrodes is in electrical communication with the electrical source and the emitting device. The emitting device emits light and/or sound when a conductive material creates a current path between the pair of electrodes, and the conductive material creates the current path when an orientation of the soap bar changes.

In yet another aspect, the invention provides a melt and pour soap bar formulation including a transparent or translucent cleaning composition, and a plurality of dispersed articles, wherein the articles comprise a light source that produces visible light. The formulation is solid below 120° F., and the formulation can be remelted and remolded.

In still another aspect, the invention provides a melt and pour soap bar formulation including a cleaning composition, and a plurality of dispersed articles, wherein the articles comprise a sound emitting device. The formulation is solid below 120° F., and the formulation can be remelted and remolded.

With a ultra clear soap like a melt and pour or alcohol based soap bar, one can add articles having a light source (such as a glowing material) or a sound emitting device of different constructions to the center of the soap bar which in turn exhibits its sound and/or illuminating properties through the transparent or translucent formulation better than other soap types.

In addition to a glowing material, a mechanical device which has continuity points on the device which could light up when expose to a conductive material or solvent could be added so that it exhibits light properties or releases something from within the device. In addition to the added benefit of a glowing material inside the soap, or battery operated device with continuity points, additives could be added to the bar during formulation or after the melting process which could exhibit glowing characteristics to a melt and pour formulation or other clear soap, which could glow under black light or visible light and or by other wavelength producing sources.

These and other features, aspects, and advantages of the present invention will become better understood upon consideration of the following detailed description, drawings and appended claims.

BRIEF DESCRIPTION OF THE DRAWINGS

Like reference numerals will be used to refer to like parts from Figure to Figure in the following description of the drawings.

DETAILED DESCRIPTION OF THE INVENTION

Figure 1:
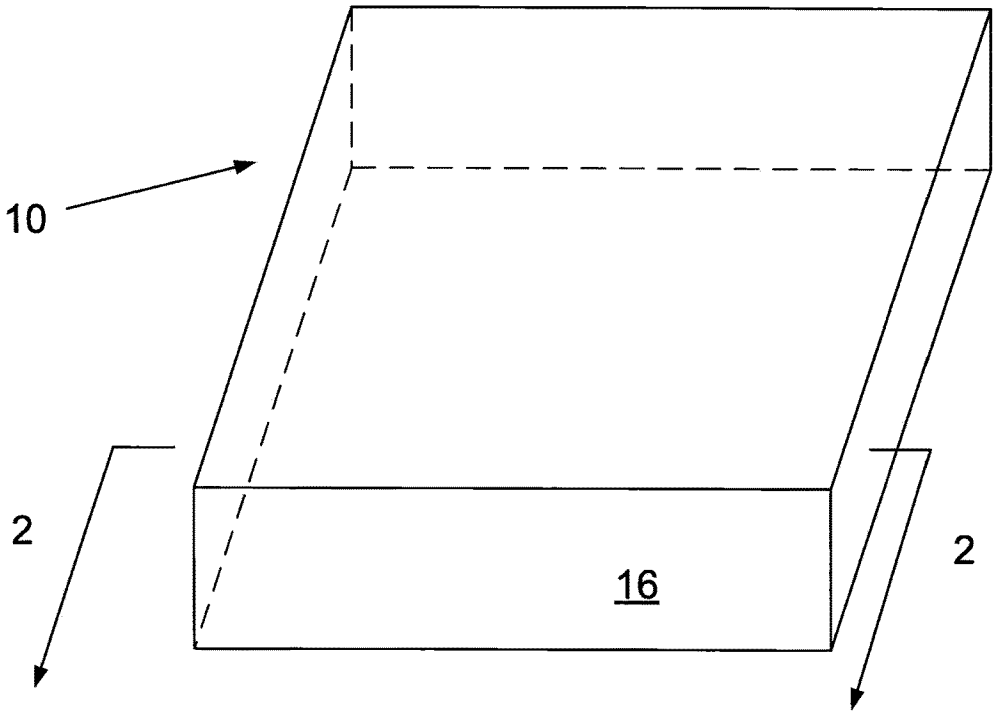
FIG. 1 is a top front perspective view of one example embodiment of a soap bar according to the invention.
Figure 2:
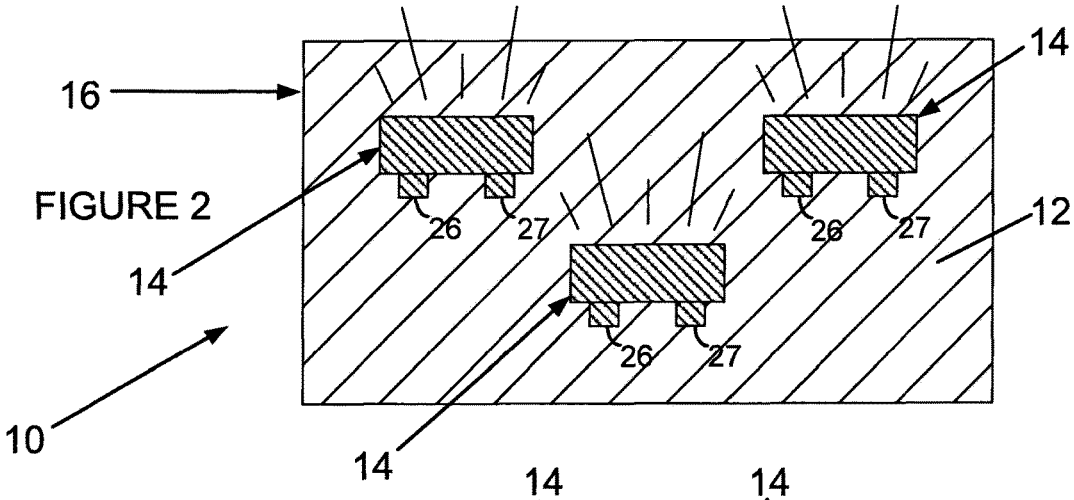
FIG. 2 is a cross-sectional view of the soap bar of FIG. 1 taken along lines 2-2 of FIG. 1.

Referring first to FIGS. 1 and 2, one embodiment of a soap bar 10 of the present invention is shown. A cleaning composition 12 is shown encapsulating a plurality of dispersed articles 14. The dispersed articles 14 are preferably suspended within the cleaning composition 12 but may optionally be positioned such that the dispersed articles 14 are in contact with an outer surface 16 of the soap bar 10. Preferably the dispersed articles 14 be distributed evenly throughout the entire soap bar 10.

A. Cleaning Composition

The cleaning composition 12 forms a solid or semi-solid matrix which at least partially encompasses each of the dispersed articles 14. In one non-limiting embodiment, the cleaning composition 12 has a total weight of about 99% of the soap bar 10, and the dispersed articles 14 have a total weight of about 1% of the soap bar 10. In another non-limiting embodiment, the cleaning composition 12 has a total weight of about 75% of the soap bar 10, and the dispersed articles 14 have a total weight of about 25% of the soap bar 10. In another non-limiting embodiment, the cleaning composition 12 has a total weight of about 50% of the soap bar 10, and the dispersed articles 14 have a total weight of about 50% of the soap bar 10. In another non-limiting embodiment, the cleaning composition 12 has a total weight of about 25% of the soap bar 10, and the dispersed articles 14 have a total weight of about 75% of the soap bar 10. In another non-limiting embodiment, the cleaning composition 12 has a total weight of about 10% of the soap bar 10, and the dispersed articles 14 have a total weight of about 90% of the soap bar 10. The cleaning composition 12 may comprise the majority of the soap bar 10 by weight. The cleaning composition 12 is preferably a solid of a hardness such that the soap bar 10 retains its shape and is self supporting after molding from a flowable mass.

The cleaning composition 12 includes one or more surfactants which provide lather and assist in the removal of soils. Preferably, the surfactants should be sufficiently mild to skin and eyes to be suitable for everyday use in cleaning the body. However, the cleaning composition is not limited to cleaning the body. For example, it can be used for washing pools, ponds and the like.

Anionic surfactants are suitable for use as one or more of the surfactants in the cleaning composition 12. Anionic surfactants can comprise about 2% to about 60%, or about 2% about 45%, or about 5% to about 35% by weight of the cleaning composition 12.

A soap that can disperse in water is one example anionic surfactant. Non-limiting example water-dispersable soaps include $C_6$-$C_{14}$ saturated fatty acid soaps and $C_{16}$-$C_{18}$ unsaturated and polyunsaturated fatty acid soaps, and mixtures and combinations thereof. These water-dispersable soaps can be derived from fats such as tallow, coconut oil, palm kernel oil, laurel oil, olive oil, and canola oil. The term "soap" means the alkali metal or alkanol ammonium salts of aliphatic alkane- or alkene monocarboxylic acids. Soaps may be made by soap manufacturing processes wherein natural fats and oils such as tallow or coconut oil or their equivalents are saponified with an alkali metal hydroxide. Alternatively, the soaps may be made by neutralizing fatty acids, such as lauric ($C_{12}$), myristic ($C_{14}$), palmitic ($C_{16}$), or stearic ($C_{18}$) acids with an alkali metal hydroxide or carbonate or alkanolamide.

A synthetic surfactant is another example anionic surfactant. The synthetic anionic surfactant may be an aliphatic sulfonate, such as a primary alkane (e.g., $C_8$-$C_{22}$) sulfonate, primary alkane (e.g., $C_8$-$C_{22}$) disulfonate, $C_8$-$C_{22}$ alkene sulfonate, $C_8$-$C_{22}$ hydroxyalkane sulfonate or alkyl glyceryl ether sulfonate. The synthetic anionic surfactant may also be an alkyl sulfate (e.g., $C_{12}$-$C_{18}$ alkyl sulfate) or alkyl ether sulfate. The synthetic anionic surfactant may also be $C_{10}$ to $C_{18}$ alkyl sulfosuccinates; alkyl and acyl taurates, alkyl and acyl sarcosinates, fatty N-acyl amino acid salts, sulfoacetates, $C_8$-$C_{22}$ alkyl phosphates, alkyl phosphate esters and alkoxyl alkyl phosphate esters, acyl lactates, $C_8$-$C_{22}$ monoalkyl succinates and maleates, sulphoacetates, and acyl isethionates, and the like.

Amphoteric surfactants are suitable for use as one or more of the surfactants in the cleaning composition 12. Amphoteric surfactants include at least one acid group. This acid group may be a carboxylic or a sulphonic acid group. They also include quaternary nitrogen and therefore are quaternary amido acids. The amphoteric surfactant can be a sulphobetaine. One example sulfobetaine is cocoamidopropyl hydroxy sultaine. Amphoacetates and diamphoacetates are useful, such as sodium lauroamphoacetate, sodium cocoamphoacetate, and blends thereof, and the like. Other example amphoteric surfactants are alkyl betaines such as cocobetaine, or alkylamidoalkyl betaines, such as cocoamidoproyl betaine or mixtures thereof. Example levels of amphoteric surfactant in the cleaning composition 12 by weight are in the range from about 1% to about 15%.

Nonionic surfactants are suitable for use as one or more of the surfactants in the cleaning composition 12. When present, nonionic surfactants may be used at levels from 1% to about 50%, or about 1% to about 25%, or from about 1% to about 10% by weight of the cleaning composition 12. Non-limiting examples of nonionic surfactants are ($C_{12}$-$C_{22}$) fatty alcohol-ethylene oxide condensates. The nonionic surfactant may also be a $C_{10}$ to $C_{16}$ fatty alkanol amide such as cocamide MEA. Other types of suitable nonionic surfactants are alkyl glycosides and alkylipolyglycosides which can be broadly defined as condensates of long chain alcohols, e.g., $C_8$-$C_{30}$ alcohols, with sugars or starches, i.e., glycosides or polyglycosides. Other useful nonionic surfactants include polyhydroxy fatty acid amide surfactants, or amine oxides.

Cationic surfactants are suitable for use as one or more of the surfactants in the cleaning composition 12. Cationic surfactants may be used from about 1% to about 20%, or from about 1% to about 10%, or from about 1% to about 5% by weight of the cleaning composition 12. Examples of cationic surfactants are the quaternary ammonium compounds such as alkyldimethylammonium halides.

In addition to one or more surfactants, the cleaning composition 12 can include various optional ingredients such as water-soluble solvents, colorants, benefit agents, and structuring agents.

Non-limiting examples of water soluble organic solvents are $C_1$-$C_{10}$ mono- or polyhydric alcohols and/or their alkoxylated ethers. Examples of this group include ethanol, isopropanol, propanol, butanol, propylene glycol, ethylene glycol monoethyl ether, hexylene glycol, glycerin (propane-1,2,3-triol), sorbitol and mixtures thereof. Another group of suitable water soluble organic solvents include polyalkylene oxides such as polyethylene oxide and polypropylene oxide. Another type of water soluble organic solvent is an alkanolamine such as triethanolamine. The water soluble organic solvent(s) may be present at a level of from 0 to about 50%, or from about 2 to about 35%, or from about 2% to 30% based on the total weight of the cleaning composition 12.

Non-limiting examples of colorants include: (1) the various FD&C dyes and their mixtures, or (2) colorants from vegetable and mineral sources such as green tea, ground henna, indigo root; kelp, poppy seeds, sage, sea clay, seaweeds, tumeric, yellow illite, and mixtures thereof. The level of colorant depends on the desired transparency or translucency.

The cleaning composition 12 may include a benefit agent that provides some sensory or functional benefit that is delivered during or after the cleansing process. Non-limiting examples of benefit agents are: (i) fragrances, (ii) lipids that are useful in skin barrier function and repair such as cholesterol, (iii) fat soluble vitamins such as vitamin A, vitamin B-3, and vitamin E, (iv) UV A and UV B absorbers (sunscreens) such as octyl methoxy cinnamate and butyl methoxy benzoylmethane, (v) anti-aging agents such as retinol esters, and fatty long chain alpha hydroxy acids, (vi) antioxidants used to reduce photodamage and premature damage due to excessive oxidation such as Vitamin E acetate, (vii) moisturizers, and (viii) insect repellents, pesticides, and/or insecticides. Any mixture of these benefit agents can comprise from about 0.0001% to about 20%, or from about 0.05% to about 15%, or from 0.1% to about 10% by weight of the cleaning composition 12.

The cleaning composition 12 may include a structuring agent. Structuring of the cleaning composition 12 is often provided by the surfactants themselves. However, in some circumstances additional structuring agents prove useful and can be employed in the invention at levels between about 0.5% and about 15% by weight, or between about 1% and about 10% by weight of the cleaning composition 12. Non-limiting examples of structuring agents include: (i) monoglycerides, diglycerides, and triglycerides such as hydrogenated cotton seed oil, (ii) sugars, (Iii thermosetting polymers such as gelatin and carrageenan, and (iv) fillers such as inorganic minerals (e.g., calcium sulfate and the like), starches, and waxes.

The surfactant system and various optional ingredients are chosen so as to provide a translucent or transparent matrix of the cleaning composition 12. A transparent matrix is one that allows for viewing of objects behind it. A translucent matrix is one which allows light to pass through it but the light may be scattered such that it will not be completely possible to clearly identify objects behind the translucent matrix. Preferably, the cleaning composition is a low cloud point composition.

The level of transparency or translucency of a matrix can be quantified by the measurement of light transmittance using for example a spectrophotometer. For example, different samples of the cleaning composition 12 of a constant thickness can be prepared, and the % transmittance of light, from 400-800 nanometers, through the samples can be measured. In an opaque cleaning composition (i.e., non-translucent), the transmittance of light through a sample is zero, while in a translucent or transparent cleaning composition, a progressively larger amount of light is transmitted.

Refractive index values can also be used to quantify the level of transparency or translucency of a matrix. In one form, the matrix has a refractive index range of 1.41-1.50. In another form, the matrix has a refractive index range of 1.31-1.40. In another form, the matrix has a refractive index range of 1.21-1.30. In another form, the matrix has a refractive index range of 1.11-1.20. In another form, the matrix has a refractive index range of 1.0-1.10. The transmittance of the matrix can suggest cloud points no greater than a certain value.

B. Dispersed Articles

Figure 6:
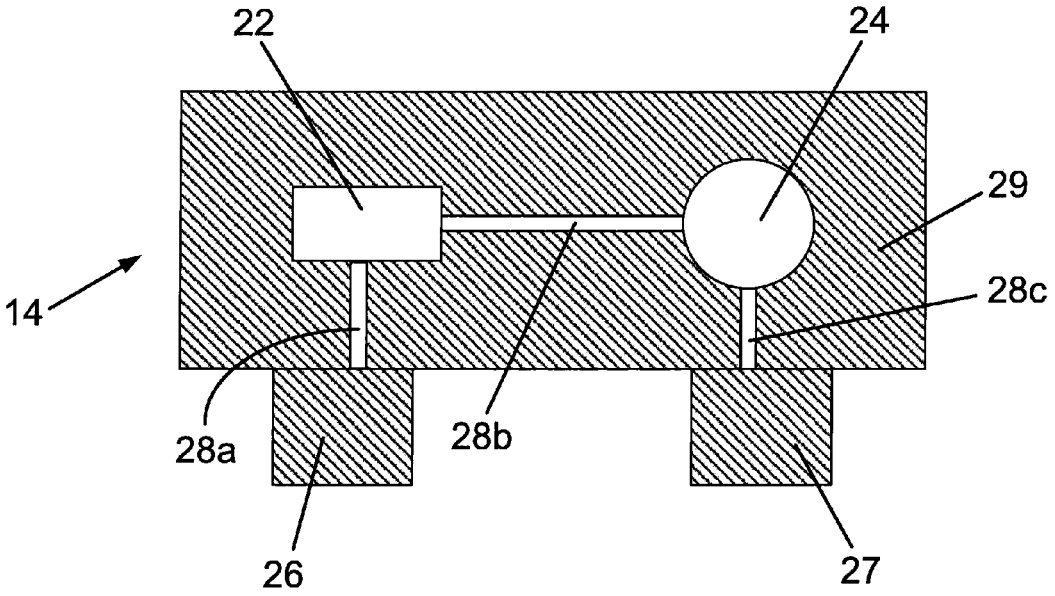
FIG. 6 is a detailed cross-sectional view similar to FIG. 2 of one example dispersed article of the soap bar of FIG. 1.

Referring to FIG. 2, the articles 14 are shown dispersed in the cleaning composition 12. The articles 14 are also shown in more detail in FIG. 6. The articles 14 include an electrical source 22, such as a battery or photovoltaic cell. The articles 14 include a light source 24 that emits visible light as a result of an electric current from the electrical source 22 being passed through the light source 24. A light emitting diode is one suitable light source 24. A pair of electrodes 26, 27 are arranged in spaced apart relationship. The pair of electrodes 26, 27 are in electrical communication with the electrical source 22 and the light source 24 by way of electrical leads 28*a*, 28*b*, 28*c*. A housing 29 can keep the electrical source 22, the light source 24, the electrodes 26, 27, and the electrical leads 28*a*, 28*b*, 28*c* assembled together.

Figure 4:
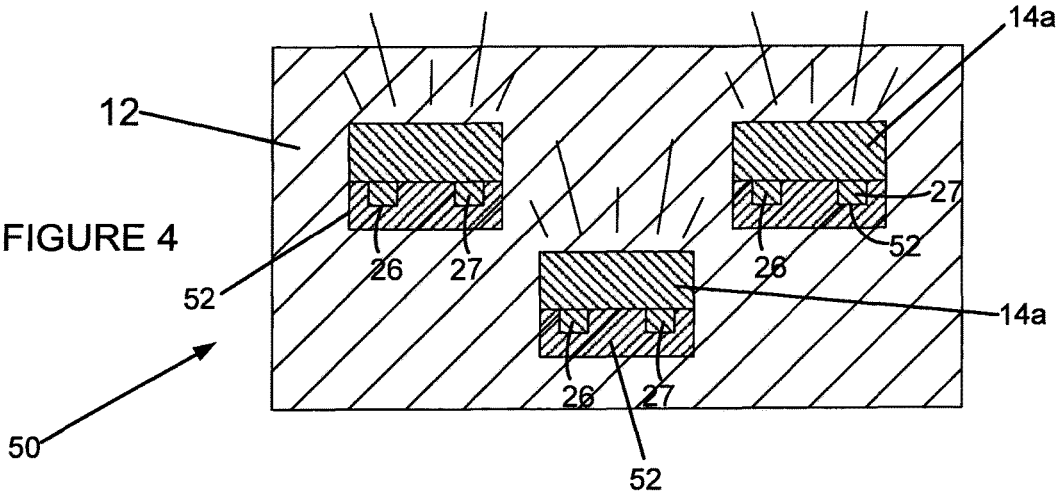
FIG. 4 is a cross-sectional view similar to FIG. 2 of yet another example embodiment of a soap bar according to the invention.

When a user washes an object with the soap bar 10 of FIGS. 1, 2 and 4, the cleaning composition 12 will dissolve in a solvent, typically water. When enough of the cleaning composition 12 dissolves, the water will create a current path between the electrodes 26, 27 and the light source 24 will emit visible light that can be seen through the transparent or translucent cleaning composition 12. Thus, a section of the matrix of the cleaning composition 12 covers the pair of electrodes 26, 27 and prevents the conductive material (e.g., water) from creating the current path until the section of the matrix is removed by dissolution thereby uncovering the pair of electrodes 26, 27. The conductive material that creates the current path between the pair of electrodes 26, 27 is not limited to the solvent that dissolves cleaning composition 12. For example, water may dissolve the cleaning composition 12, but the conductive material may be a person's skin that creates the current path between the pair of electrodes 26, 27.

Figure 3:
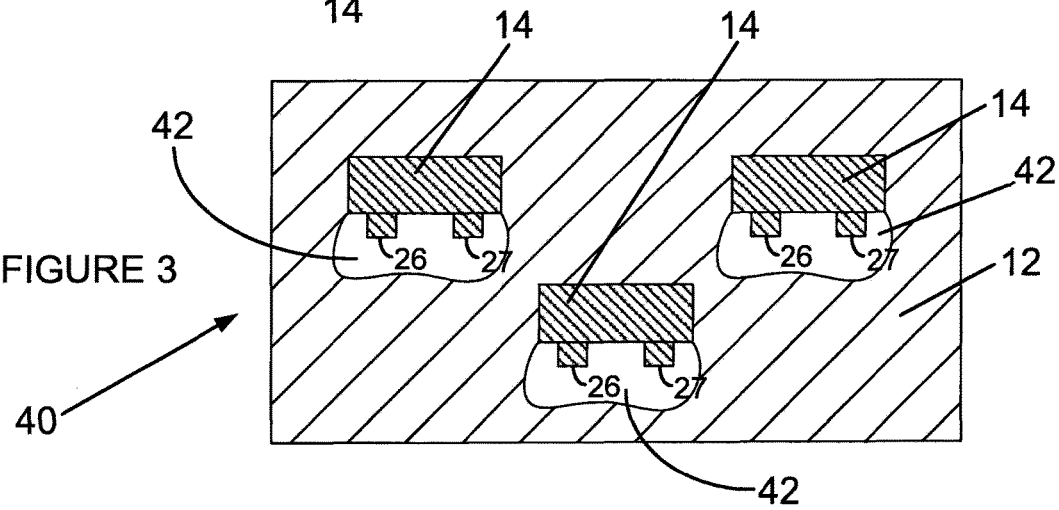
FIG. 3 is a cross-sectional view similar to FIG. 2 of another example embodiment of a soap bar according to the invention.

Turning now to FIG. 3, there is a cross-sectional view of another example embodiment of a soap bar 40 according to the invention. Articles 14 are shown dispersed in the cleaning composition 12. Under some circumstances, the cleaning composition 12 may have a conductivity sufficient to create the current path between the pair of electrodes 26, 27. In order to avoid emission of light from the light source 24 before use by a consumer, an air pocket 42 is created around the electrodes 26, 27. This provides an electrically insulating gap between the electrodes 26, 27. When enough of the cleaning composition 12 dissolves, the water will enter the pocket 42 create a current path between the electrodes 26, 27, and the light source 24 will emit visible light that can be seen through the transparent or translucent cleaning composition 12. Thus, the air pocket 42 prevents emission of light from the light source 24 before use by a consumer.

Turning now to FIG. 4, there is a cross-sectional view of another example embodiment of a soap bar 50 according to the invention. Articles 14*a* are shown dispersed in the cleaning composition 12. As detailed above, certain cleaning compositions 12 may have a conductivity sufficient to create the current path between the pair of electrodes 26, 27. In order to avoid emission of light from the light source 24 before use by a consumer, a non-conductive dissolvable film 52 is arranged on the electrodes 26, 27 of the articles 14*a*. This provides an electrically insulating film 52 between the electrodes 26, 27. When enough of the cleaning composition 12 and the film 52 dissolves, the water will create a current path between the electrodes 26, 27, and the light source 24 will emit visible light that can be seen through the transparent or translucent cleaning composition 12. However, the film 52 prevents emission of light from the light source 24 before use by a consumer. Various materials are suitable for use in the electrically insulating film 52. Non-limiting example materials include gels, glycerin, sodium compounds, stearic acid, polyvinyl alcohol, and lipids with a low melting point. Preferably, the film 52 is a polar material that electrically insulates the electrodes 26, 27 and that will dissolve in a polar material such as water. The film 52 should not dissolve in the cleaning composition 12, or should only minimally dissolve in the cleaning composition 12.

In another embodiment of the invention, film 52 is a non-dissolvable film that increases conductivity upon a temperature change. When the film 52 becomes more conductive due to a temperature change, a current path is created between the electrodes 26, 27, and the light source 24 will emit visible light that can be seen through the transparent or translucent cleaning composition 12. For example, the film may be a sintered metal oxide commonly used in a negative temperature coefficient thermistor. These materials increase in conductivity upon a temperature increase such as provided by water above room temperature.

In another embodiment of the invention, film 52 is a non-dissolvable film that becomes conductive upon application of pressure. When the film 52 becomes conductive due to a pressure change, a current path is created between the electrodes 26, 27, and the light source 24 will emit visible light that can be seen through the transparent or translucent cleaning composition 12. Polyvinylidene fluoride is material that could exhibit conductivity upon application of pressure, such as the pressure from a user's hands.

In another embodiment of the invention, film 52 is a dissolvable film that upon dissolving uncovers a photoconductive material that becomes conductive upon application of light. For example, a photoconductive polymer such as polyvinylcarbazole can be placed under an opaque dissolvable film 52. The photoconductive polymer is in contact with the electrodes 26, 27. When the film 52 dissolves in water, light contacting the photoconductive material creates a current path between the electrodes 26, 27, and the light source 24 will emit visible light that can be seen through the transparent or translucent cleaning composition 12.

Figure 5:
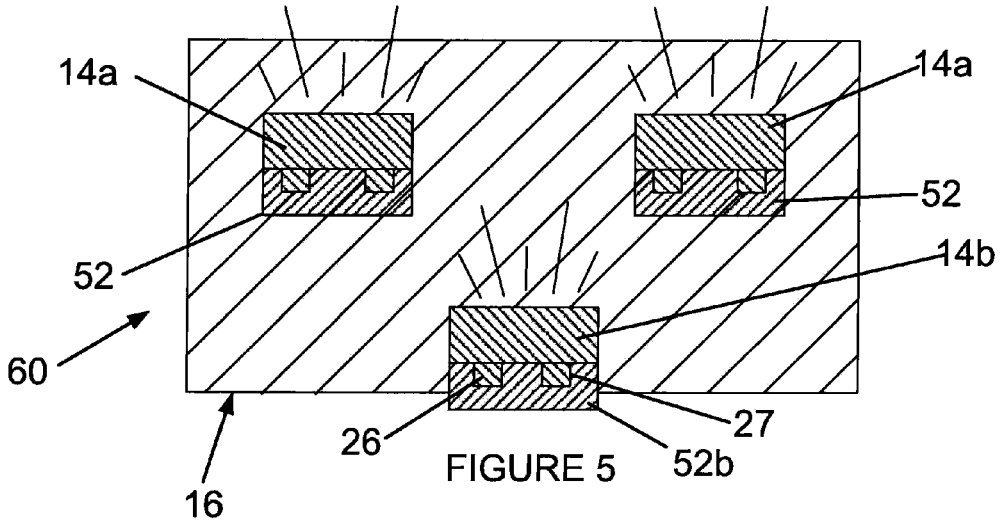
FIG. 5 is a cross-sectional view similar to FIG. 2 of still another example embodiment of a soap bar according to the invention.

Turning now to FIG. 5, there is a cross-sectional view of another example embodiment of a soap bar 60 according to the invention. Articles 14*a* with the dissolvable film 52 as described above are shown dispersed in the cleaning composition 12 of the soap bar 60. Therefore, articles 14*a* with the dissolvable film 52 will not be described again. However, in the soap bar 60, a different article 14*b* is also provided. Article 14*b* is located at the outer surface of the soap bar 60. In order to avoid emission of light from the light source 24 in the article 14*b* before use by a consumer, a peelable film 52*b* is arranged on the electrodes 26, 27 of the article 14*b*. This provides an electrically insulating film 52*b* between the electrodes 26, 27. A user can create a current path between the electrodes 26, 27 and the light source 24 in order to emit visible light by peeling away the film 52*b* and placing a conductive material (e.g., water, skin) between the electrodes 26, 27. However, the film 52*b* prevents emission of light from the light source 24 before activation by a consumer. Various materials are suitable for use in the electrically insulating film 52*b*. Non-limiting example materials include silicones. The soap bar 60 can include various numbers of the articles 14*a* with the dissolvable film 52 and the articles 14*b* with the peelable film 52*b*.

Figure 7:
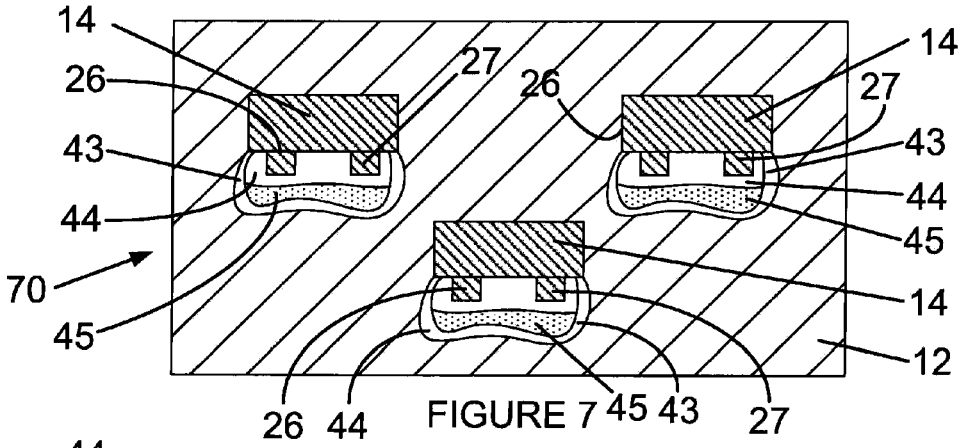
FIG. 7 is a cross-sectional view similar to FIG. 2 of yet another example embodiment of a soap bar according to the invention.
Figure 8:
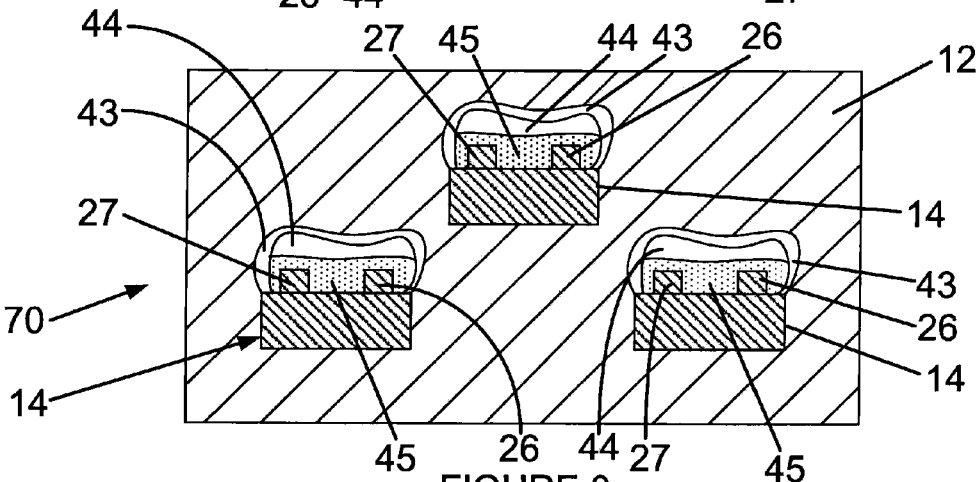
FIG. 8 is a cross-sectional view of the soap bar of FIG. 7 with the soap bar rotated 180 degrees.

Turning now to FIGS. 7 and 8, there is a cross-sectional view of another example embodiment of a soap bar 70 according to the invention. The soap bar 70 has alternative means for creating a current path between the electrodes 26, 27. Specifically, a motion detection system having an open circuit position and a closed circuit position is placed in a circuit path between the electrodes 26, 27. Inversion of the soap bar 70 moves the motion detection system from the open circuit position of FIG. 7 to the closed circuit position of FIG. 8 such that the light source 24 will emit visible light that can be seen through the transparent or translucent cleaning composition 12. Articles 14 are shown dispersed in the cleaning composition 12. A liquid impermeable wall 43 creates a well 44 around the electrodes 26, 27. The wall 43 can comprise, for example, a wax or a polyolefin. A conductive liquid 45 is contained in the well 44. The conductive liquid 45 does not occupy the entire volume of the well 44.

When the soap bar 70 is in the open circuit position of FIG. 7, the conductive liquid 45 does not contact the electrodes 26, 27 thereby providing an electrically insulating air gap between the electrodes 26, 27. When the soap bar 70 is moved into the closed circuit position of FIG. 8, the conductive liquid 45 contacts the electrodes 26, 27 creating a current path between the electrodes 26, 27, and the light source 24 will emit visible light that can be seen through the transparent or translucent cleaning composition 12. Thus, motion of the soap bar 70 can cause emission of light from the soap bar 70.

Figure 9:
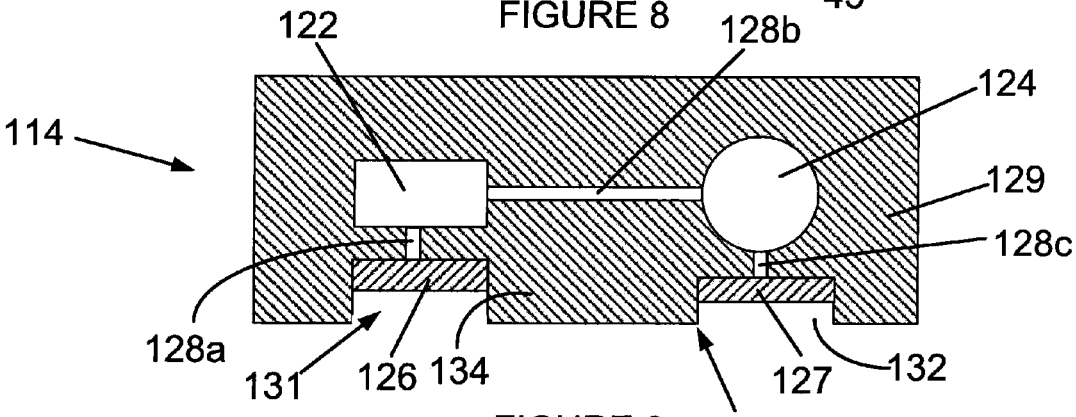
FIG. 9 is a detailed cross-sectional view similar to FIG. 2 of another example dispersed article of the soap bar.

Referring now to FIG. 9, another example dispersed article 114 is shown. Article 114 can be dispersed in the cleaning composition 12. The article 114 includes an electrical source 122, such as a battery or photovoltaic cell. The articles 114 include a light source 124 that emits visible light as a result of an electric current from the electrical source 122 being passed through the light source 124. A light emitting diode is one suitable light source 124. A pair of electrodes 126, 127 are arranged in spaced apart relationship. The pair of electrodes 126, 127 are in electrical communication with the electrical source 122 and the light source 124 by way of electrical leads 128*a*, 128*b*, 128*c*. A housing 129 can keep the electrical source 122, the light source 124, the electrodes 126, 127, and the electrical leads 128*a*, 128*b*, 128*c* assembled together. The electrodes 126, 127 are not flush with the housing 129. Note the recesses 131, 132 created in the outer surface 133 of the housing 129. The recesses 131, 132 provide control of the lighting of the light source 124 in that the film of water on the housing 129 must be sufficient to create a conductive path between the electrodes 126, 127 and over the raised area 134 of the housing 129. The cleaning composition 12 in the recesses 131, 132 must first dissolve so that the water can create a current path between the electrodes 126, 127.

The soap bars 10, 40, 50, 60 and 70 can be made as follows. In a first step, a mixture with the articles 14 dispersed in the cleaning composition 12 is formed. When making a glycerin soap, one or more surfactants and glycerin (or another polyol) can be chosen for the cleaning composition 12. One preferred method for dispersing the articles 14 is by melting the cleaning composition 12 and stirring to keep the articles 14 dispersed. In a second step, the mixture is poured into molds that will give the soap bars the individual bar shape. The pouring process is preferably done at elevated temperatures to prevent the cleaning composition 12 from solidifying before it is poured into the molds. The preferred temperature is between about 120° F. to about 200° F. The articles 14 should not degrade or melt at this temperature. The location of the article 14*b* in the soap bar 60 can be accomplished by forming recesses in the mold wall that hold the article 14*b* during molding.

While the articles 14, 14*a*, 14*b*, 114 have been described above with reference to the emission of light from the light source 24 by electroluminescence (from a light emitting diode), other types of luminescence can be used to provide the visible light. For example, bioluminescence, i.e., light emission by a living organism, can be used by incorporating a bioluminescent species into the articles 14, 14*a*, 14*b*, 114 and triggering the bioluminescence by contact of the articles 14, 14*a*, 14*b*, 114 with water. Chemiluminescence, i.e., light emission as a result of a chemical reaction, can be used by incorporating a chemiluminescent reactants into the articles 14, 14*a*, 14*b*, 114 and triggering the chemiluminescence by contact of the articles 14, 14*a*, 14*b*, 114 with water. Photoluminescence, i.e., light emission as a result of the absorption of photons, can be used by incorporating a photoluminescent material into the articles 14, 14*a*, 14*b*, 114 and triggering the photoluminescence by contact of the articles 14, 14*a*, 14*b*, 114 with photons. Photoluminescence can be achieved with fluorescent and/or phosphorescent materials.

Other dispersed articles are possible. For instance, a sponge-like material or other material which will increase in size when exposed to water can be included in the soap bars 10, 40, 50, 60 and 70. While the articles 14, 14*a*, 14*b*, 114 have been described above with reference to the emission of light from the light source 24, the light source can be replaced with a sound emitting device that creates sound as a result of an electric current from the electrical source 22 being passed to the sound emitting device. Various combinations of the articles can be used in the soap bars. For example, light emitting devices of different wavelengths can be used in a single soap bar, or light emitting devices and sound emitting devices can be used in a single soap bar, either in separate articles or in articles that include a circuit with both a light source and a sound emitting device.

Thus, the invention provides a soap bar and a melt and pour soap bar formulation including a transparent or translucent cleaning composition, and a plurality of dispersed articles wherein one or more of the articles comprises a light source that produces visible light or a sound emitter.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A soap bar comprising:

a solid or semi-solid matrix comprising a cleaning composition, the matrix being transparent or translucent; and an article positioned in the matrix, the article including an electrical source, a light source, and a pair of electrodes in spaced apart relationship, the pair of electrodes being in electrical communication with the electrical source and the light source, wherein the light source emits light when a conductive material creates a current path between the pair of electrodes, and wherein a section of the matrix covers the pair of electrodes and prevents the conductive material from creating the current path until the section of the matrix is removed thereby uncovering the pair of electrodes.

2. A soap bar comprising:

a solid or semi-solid matrix comprising a cleaning composition; and an article positioned in the matrix, the article including an electrical source, a sound emitting device, and a pair of electrodes in spaced apart relationship, the pair of electrodes being in electrical communication with the electrical source and the sound emitting device, wherein the sound emitting device emits sound when a conductive material creates a current path between the pair of electrodes, and wherein a section of the matrix covers the pair of electrodes and prevents the conductive material from creating the current path until the section of the matrix is removed thereby uncovering the pair of electrodes.

3. The soap bar of claim 1 wherein:

the conductive material comprises water, the section of the matrix comprises a portion of the cleaning composition covering the pair of electrodes, and the portion of the cleaning composition dissolves in the water thereby uncovering the pair of electrodes.

4. The soap bar of claim 3 wherein:

the portion of the cleaning composition is in contact the pair of electrodes before dissolving.

5. The soap bar of claim 3 wherein:

the portion of the cleaning composition creates a pocket around the pair of electrodes before dissolving.

6. The soap bar of claim 1 wherein:

the conductive material comprises water, the section of the matrix comprises a non-conductive dissolvable film covering the pair of electrodes, the film dissolves in the water thereby uncovering the pair of electrodes, and the film does not dissolve in the cleaning composition when coated with the cleaning composition.

7. The soap bar of claim 1 wherein:

the section of the matrix comprises a non-conductive peelable film covering the pair of electrodes adjacent the outer surface of the matrix, and the film is suitable for being mechanically removed thereby uncovering the pair of electrodes, and the film avoids activation of the light source until removed mechanically.

8. The soap bar of claim 1 wherein:

the pair of electrodes are recessed in relation to an outer surface of the article.

9. The soap bar of claim 2 wherein:

the conductive material comprises water, the section of the matrix comprises a portion of the cleaning composition covering the pair of electrodes, and the portion of the cleaning composition dissolves in the water thereby uncovering the pair of electrodes.

10. The soap bar of claim 9 wherein:

the portion of the cleaning composition is in contact the pair of electrodes before dissolving.

11. The soap bar of claim 9 wherein:

the portion of the cleaning composition creates a pocket around the pair of electrodes before dissolving.

12. The soap bar of claim 2 wherein:

the conductive material comprises water, the section of the matrix comprises a non-conductive dissolvable film covering the pair of electrodes, the film dissolves in the water thereby uncovering the pair of electrodes, and the film does not dissolve in the cleaning composition when coated with the cleaning composition.

13. The soap bar of claim 2 wherein:

the section of the matrix comprises a non-conductive peelable film covering the pair of electrodes adjacent the outer surface of the matrix, and the film is suitable for being mechanically removed thereby uncovering the pair of electrodes, and the film avoids activation of the light source until removed mechanically.

14. The soap bar of claim 2 wherein:

the pair of electrodes are recessed in relation to an outer surface of the article.

* * * * *